US006183926B1

(12) United States Patent
Kuroda et al.

(10) Patent No.: US 6,183,926 B1
(45) Date of Patent: Feb. 6, 2001

(54) TONER AND TWO-COMPONENT DEVELOPER FOR ELECTROPHOTOGRAPHIC PROCESS AND IMAGE FORMATION METHOD AND IMAGE FORMATION APPARATUS USING THE TONER

(75) Inventors: Noboru Kuroda; Yasushi Nakamura; Ryoichi Ito; Yasuaki Iwamoto; Kohki Katoh; Tomio Kondou; Kenichi Uehara; Yoshihiro Sugiyama; Yasuyuki Sanui, all of Shizuoka (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/425,985

(22) Filed: Oct. 25, 1999

(30) Foreign Application Priority Data

Oct. 26, 1998 (JP) ..... 10-319860
Mar. 12, 1999 (JP) ..... 11-067489

(51) Int. Cl.[7] ..... G03G 9/083
(52) U.S. Cl. ..... 430/106.6; 430/111; 399/223
(58) Field of Search ..... 430/106, 109, 430/110, 111, 106.6; 399/223

(56) References Cited

U.S. PATENT DOCUMENTS 4,980,258 12/1990 Aoki et al. ..... 430/110
5,014,089 * 5/1991 Sakashita et al. ..... 430/111
5,104,764 * 4/1992 Wada et al. ..... 430/109
5,225,303 7/1993 Tomita et al. ..... 430/106.6
5,380,616 1/1995 Aoki et al. ..... 430/110
5,840,456 11/1998 Tomita et al. ..... 430/106

FOREIGN PATENT DOCUMENTS 0 314 459 5/1989 (EP) .
0 330 498 8/1989 (EP) .
0 541 113 5/1993 (EP) .
0 606 930 7/1994 (EP) .

* cited by examiner

*Primary Examiner*—John Goodrow
(74) *Attorney, Agent, or Firm*—Oblon, Spivak, McClelland, Maier & Neustadt, P.C.

(57) ABSTRACT

A toner is made or toner particles which contains a binder resin and a coloring agent, wherein the toner particles have a weight-average particle size in a range of 6.0 to 11.5 $\mu$m, and contains toner particles (a) with a particle diameter of 5 $\mu$m or less in a content ratio of 1 to 15% by number, and toner particles (b) with a particle diameter of twice or more the weight-average particle size in a content ratio of 5 wt % or less, and the number-average particle size D25 and the number-average particle size D75 respectively obtained when the cumulative number of the toner particles reaches 25% and 75% at the measurement of a cumulative toner particle distribution by number thereof are in the relationship of $0.60 \leqq D25/D75 \leqq 0.95$. A two-component developer includes the above-mentioned toner and a carrier.

36 Claims, 4 Drawing Sheets

TONER AND TWO-COMPONENT DEVELOPER FOR ELECTROPHOTOGRAPHIC PROCESS AND IMAGE FORMATION METHOD AND IMAGE FORMATION APPARATUS USING THE TONER

BACKGROUND OF THE INVENTION

1. Field of the Invention

The present invention relates to a toner and a two-component developer used in the fields of electrophotography and the electrostatic recording, and to an image formation method using the above-mentioned toner and two-component developer, more particularly to a high speed image formation method in which an organic photoconductor belt is used as a latent image bearing member, and a cleaning brush is used as the cleaning means. In addition, the present invention also relates to a toner cartridge holding the above-mentioned toner and an image formation apparatus using the above-mentioned toner.

2. Discussion of Background

In the electrophotographic process, a latent electrostatic image is formed on a photoconductor comprising a photoconductive material, using various means, and the thus formed latent electrostatic image is developed with a toner to a visible toner image, and the developed toner image is then transferred to a sheet of paper when necessary, and fixed thereon with the application of heat and/or pressure thereto, or using a vapor of a solvent, whereby a hard copy can be obtained.

As disclosed in Japanese Laid-Open Patent Application 61-147261, the method of developing the latent electrostatic image is roughly classified into a two-component development system using a toner and a carrier, and a mono-component development system using a toner alone.

In the two-component development system, the toner is mixed and stirred with the carrier so that the toner may become triboelectrically charged to a polarity opposite to that of the carrier. When the toner acquires electrical charges of a polarity opposite to that of the electrostatic image, the toner is deposited on the latent electrostatic image, thereby developing the latent electrostatic image into a visible image.

There are known many development methods depending upon the kind of carrier, for example, magnetic-brush development using iron powder as the carrier; cascade development using a beaded material as the carrier; and fur-brush development using brush fibers. The toner for use in the above-mentioned various development techniques comprises toner particles, each toner particle comprising a binder resin such as a natural resin or synthetic resin, and a coloring agent such as carbon black dispersed in the binder resin.

For instance, to obtain toner particles, a mixture prepared by dispersing a coloring agent in a binder resin such as polystyrene is pulverized until the particle size reaches about 1 to 30 $\mu$m. Further, a magnetic toner can be prepared by adding a magnetic material such as magnetite to the components such as the binder resin and the coloring agent.

On the market of the copying and printing apparatus, there is an increasing demand for not only high speed image formation and high quality image formation, but also reduction in size of the apparatus and improvement of durability of the apparatus. In response to such recent demands, the toner, photoconductor, and charge imparting material have been actively developed.

As the means for cleaning the toner particles remaining on the latent image bearing member after image transfer, a blade or fur brush is commonly employed in direct contact with the latent image bearing member. In such an electrophotographic process, the surface of the latent image bearing member, for example, a charge transport layer (CTL) of the photoconductor, is necessarily abraded because the above-mentioned cleaning member and development member are brought into direct contact with the surface of the latent image bearing member. In particular, the photoconductor of the high-speed copying or printing apparatus is required to have such abrasion resistance that can endure large quantities of copies or printings. For the above-mentioned reason, the combination of an organic photoconductor in the form of a flexible belt which has a large available surface area, and a cleaning brush capable of performing relatively moderate cleaning for the photoconductor has become the mainstream in the high-speed copying or printing apparatus. However, even though such combination is adopted, it is not adequate to the high-speed copying or printing apparatus designed to make an enormous volume of copies or printings, for example, more than one million. Namely, still more improved durability is desired with respect to the photoconductor.

In the aspect of the quality of hard copy image, the improvement of preciseness and resolution is strongly desired in recent years. However, the conventional developer has the drawback that since toner particles are selectively subjected to development during making of large quantities of copies and printings for an extended period of time, the particle size distribution of toner particles changes with time in the developer, thereby lowering the resolution of the obtained image.

To obtain a toner image with high preciseness and high resolution, various developers are proposed, as disclosed in Japanese Laid-Open Patent Applications 1-112253, 2-284158 and 7-295283. Each of the above-mentioned developers comprise toner particles with small average particle diameter, and the content of the toner particles with a particle diameter of 5 $\mu$m or less, and the particle size distribution are particularly specified.

The toner particles with a particle diameter of 5 $\mu$m or less are indispensable for the formation of a toner image with high preciseness and high resolution. It is considered that a latent image can be faithfully and exactly reproduced to obtain a sharp toner image with excellent reproducibility when the toner particles with a particle diameter of 5 $\mu$m or less are constantly supplied to the latent image formed on the photoconductor in the development step. On the other hand, the toner particles with a particle diameter of 5 $\mu$m or less produce the problem of decrease of the image density. The reason for the decrease in image density is that the intensity of the electric field in the edge portion of a latent image is stronger than that in the center portion thereof, so that the toner deposition amount in the center portion of the latent image becomes less than that in the edge portion when the above-mentioned fine toner particles are employed. However, it is supposed that this problem can be solved by particularly specifying the content ratio by number of toner particles with a particle diameter of more than 5 $\mu$m (which will be hereinafter referred to as intermediate toner particles).

The fine toner particles with a particle diameter of 5 $\mu$m or less are advantageous for practical use, as previously mentioned, but there exists an optimum content ratio of the above-mentioned fine toner particles.

For instance, in FIG. 1, a toner comprises 17% by number of toner particles with a particle diameter of 5 $\mu$m or less. In this case, the content of the toner particles with a particle diameter of 5 μm or less is only 3 wt % of the total weight of the toner particles as shown in FIG. 2. In light of such a small percentage by weight of the fine toner particles, it is doubtful that those fine toner particles can be selectively deposited to the edge portion of a latent image, and the intermediate toner particles can be selectively deposited to the center portion thereof.

In contrast to the above, in FIG. 3, the content ratio by number of toner particles with a particle diameter of 5 μm less is as much as 60%. FIG. 4 is a chart showing the particle size distribution by weight of the same toner shown in FIG. 3. In this case, there is a risk of toner particles being excessively charged under the circumstances of low temperature. The toner particles thus excessively charged are tightly attached to the surface of carrier particles and the surface of the photoconductor. Consequently, the decrease in image density and the fogging are observed in the obtained toner images. In this case, the surface of the photoconductor cannot be perfectly cleaned, and a filming phenomenon takes place on the surface of the photoconductor.

To solve the above-mentioned problem, Japanese Laid-Open Patent Application 4-1773 discloses a toner comprising toner particles with a particle size of 12.7 to 16.0 μm in an amount of 0.1 to 5.0 wt % of the total weight of the toner particles in order to improve the fluidity of toner. In this case, however, it is certain that the obtained fluidity of the above-mentioned toner is inferior to that of the toner comprising 1 to 15% by number of toner particles with a particle size of 5 μm or less. Further, in the case where the content ratio of the large toner particles with a particle size of 12.7 μm or more is increased as disclosed in the above-mentioned application, the image quality of the obtained toner image tends to become uneven.

The fluidity of toner can also be improved by increasing the amount of a fluidity imparting agent. However, the fluidity of toner varies depending upon the contact conditions of the fluidity imparting agent with the surface portions of the toner particles. To be more specific, in the toner containing as much as 60% by number of the toner particles with a particle size of 5 μm or less, the amount of fluidity imparting agent is required to increase 1.5 to 2.0 times the amount thereof necessary for the toner containing 17% by number of the toner particles with a particle size of 5 μm or less in order to obtain substantially the same fluidity. The contamination of the photoconductor and the filming phenomenon on the surface of the photoconductor, and the deterioration of image fixing performance are unavoidable when such a large quantity of fluidity imparting agent is added to the toner particles.

In Japanese Laid-Open Patent Applications 4-124682 and 10-91000, the number of toner particles with a particle size of 5 μm or less is specifically restricted. Although the effects are mentioned in the aforementioned applications when such restriction is established in the preparation of a mono-component developer, there is no description about the particle size distribution of the majority of toner particles dominantly determining the image quality. As a result, a toner image with high resolution cannot be obtained.

SUMMARY OF THE INVENTION

Accordingly, a first object of the present invention is to provide a toner with high fluidity even though the amount of additive is small, and with excellent image fixing properties, which toner can minimize the contamination and the filming phenomenon of the photoconductor.

A second object of the present invention is to provide a two-component developer comprising a toner with high fluidity even though the amount of additive is small, and with excellent image fixing properties, which toner can minimize the contamination and the filming phenomenon of the photoconductor.

A third object of the present invention is to provide a toner cartridge for holding the above-mentioned toner.

A fourth object of the present invention is to provide an image formation method with minimum deterioration of the developer and minimum abrasion of the photoconductor, free of defective cleaning and unfavorable filming of the photoconductor even though large quantities of copies or printings are made at high speed for an extended period of time.

A fifth object of the present invention is to provide an image formation apparatus with minimum deterioration of the developer and minimum abrasion of the photoconductor, free of defective cleaning and unfavorable filming of the photoconductor even though large quantities of copies or printings are made at high speed for an extended period of time.

The first object of the present invention can be achieved by a toner comprising toner particles which comprise a binder resin and a coloring agent, wherein the toner particles have a weight-average particle diameter in a range of 6.0 to 11.5 μm, and comprise toner particles (a) with a particle diameter of 5 μm or less in a content ratio of 1 to 15% by number, and toner particles (b) with a particle diameter of twice or more the weight-average particle size in a content ratio of 5 wt % or less, and satisfy the conditions that a number-average particle size D25 when the cumulative number of the toner particles reaches 25% at the measurement of a cumulative toner particle distribution by number thereof, and a number-average particle size D75 when the cumulative number of the toner particles reaches 75% at the measurement of the cumulative toner particle distribution by number thereof are in the relationship of $0.60 \leqq D25/D75 \leqq 0.85$.

Alternatively, the first object of the present invention can also be achieved by a toner comprising toner particles which comprise a binder resin and a coloring agent, wherein the toner particles have a weight-average particle size in a range of 6.0 to 9.5 μm, and comprise toner particles (a) with a particle diameter of 5 μm or less in a content ratio of 1 to 12% by number, and toner particles (b) with a particle diameter of twice or more the weight-average particle size in a content ratio of 3 wt % or less, and satisfy the aforementioned relationship of $0.70 \leqq D25/D75 \leqq 0.85$.

It is preferable that the binder resin comprise a polyol resin or a polyester resin.

Further, the toner may further comprise a magnetic material.

The second object of the present invention can be achieved by a two-component developer comprising a toner and a carrier, the toner comprising toner particles which comprise a binder resin and a coloring agent, wherein the toner particles have a weight-average particle size in a range of 6.0 to 11.5 μm, and comprise toner particles (a) with a particle diameter of 5 μm or less in a content ratio of 1 to 15% by number; and toner particles (b) with a particle diameter of twice or more the weight-average particle size in a content ratio of 5 wt % or less, and satisfy the conditions that a number-average particle size D25 when the cumulative number of the toner particles reaches 25% at the measurement of a cumulative toner particle distribution by number thereof, and a number-average particle size D75 when the cumulative number of the toner particles reaches 75% at the measurement of the cumulative toner particle distribution by number thereof are in the relationship of $0.60 \leqq D25/D75 \leqq 0.85$.

It is preferable that the carrier for use in the two-component developer comprise magnetic carrier particles with a weight-average particle size of 35 to 100 μm, more preferably 45 to 75 μm.

The third object of the present invention can be achieved by a toner cartridge holding therein the above-mentioned toner.

The fourth object of the present invention can be achieved by an image formation method comprising the steps of forming a latent image on a latent image bearing member, developing the latent image to a visible image with the above-mentioned toner, transferring the visible image to an image receiving material, and cleaning the toner remaining on the latent image bearing member.

In the image formation method, it is preferable that the latent image bearing member be an organic photoconductor belt, and the latent image bearing member be cleaned with a rotational cleaning brush in the form of a roll.

The fifth object of the present invention can be achieved by an image formation apparatus capable of forming a toner image, using the above-mentioned toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
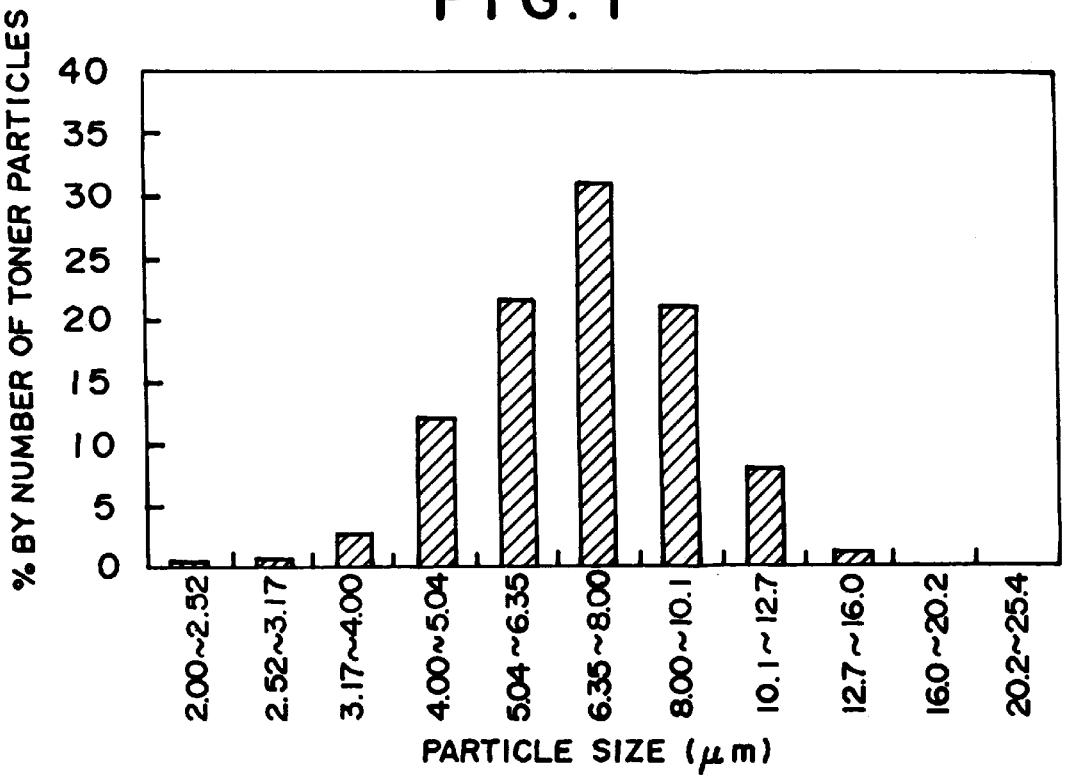
FIG. 1 is a chart showing one example of the particle size distribution of a conventional toner which contains 17% by number of toner particles with a particle diameter of 5 μm or less.
Figure 2:
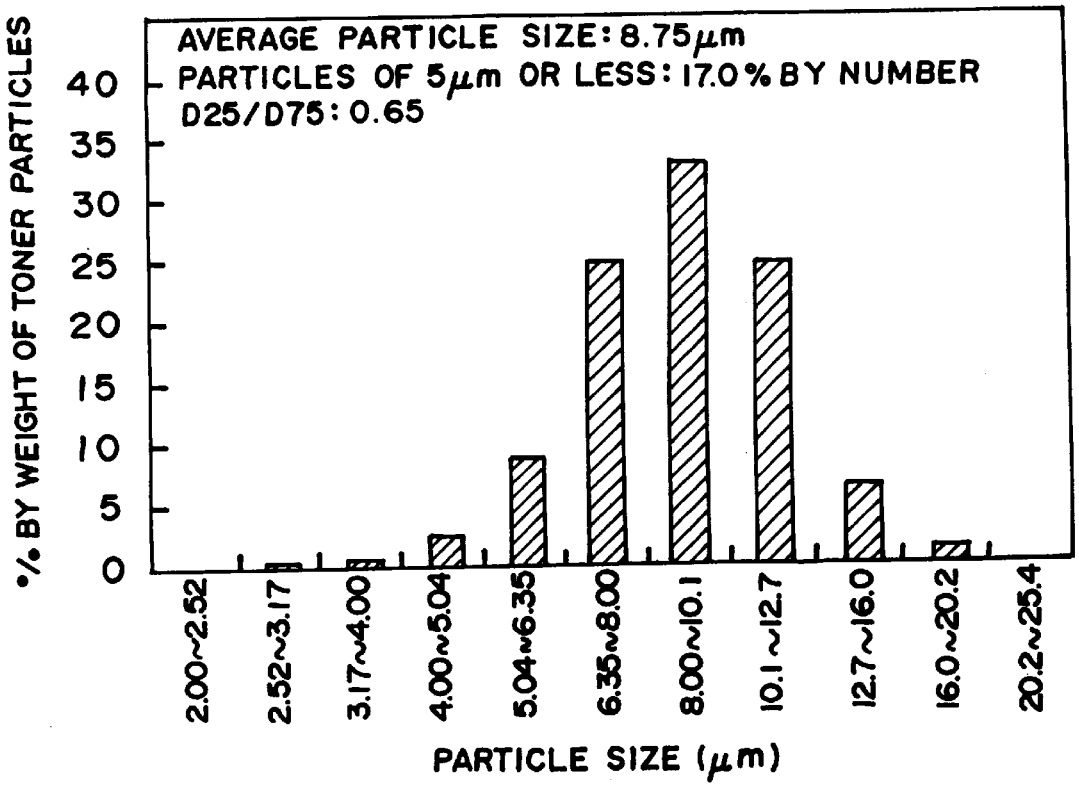
FIG. 2 is a chart showing the particle size distribution of the conventional toner shown in FIG. 1, which particle size distribution is expressed by the weight percentage.
Figure 3:
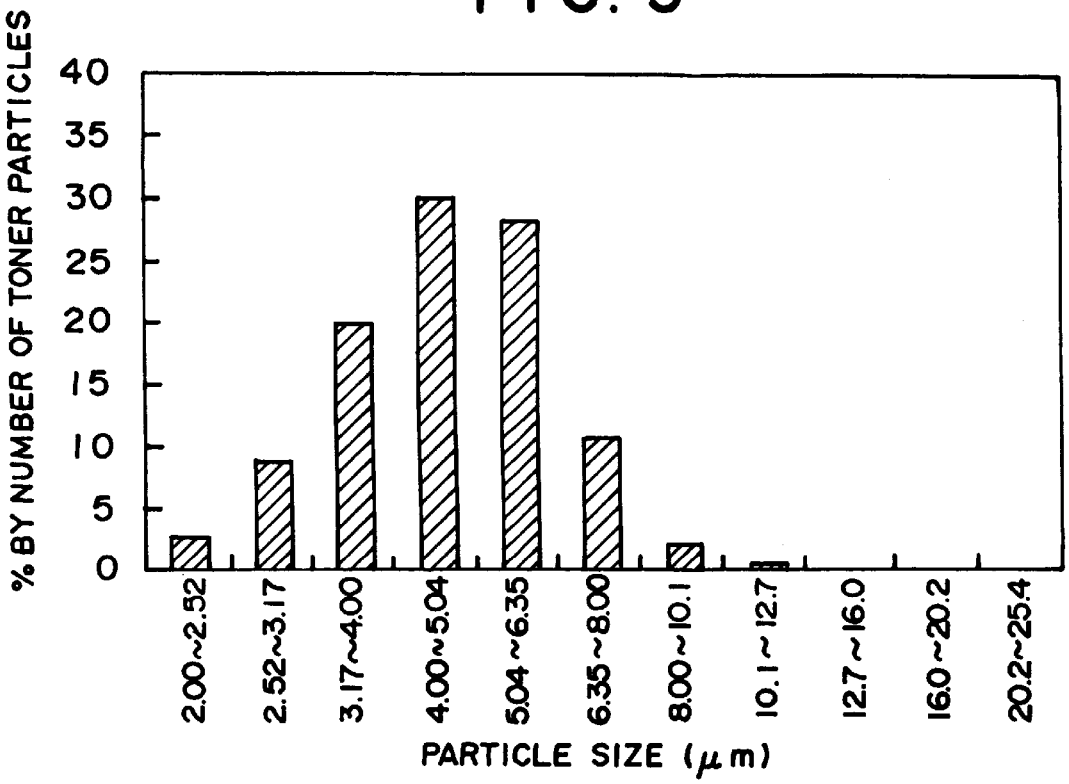
FIG. 3 is a chart showing another example of the particle size distribution of a conventional toner which contains 60% by number of toner particles with a particle diameter of 5 μm or less.
Figure 4:
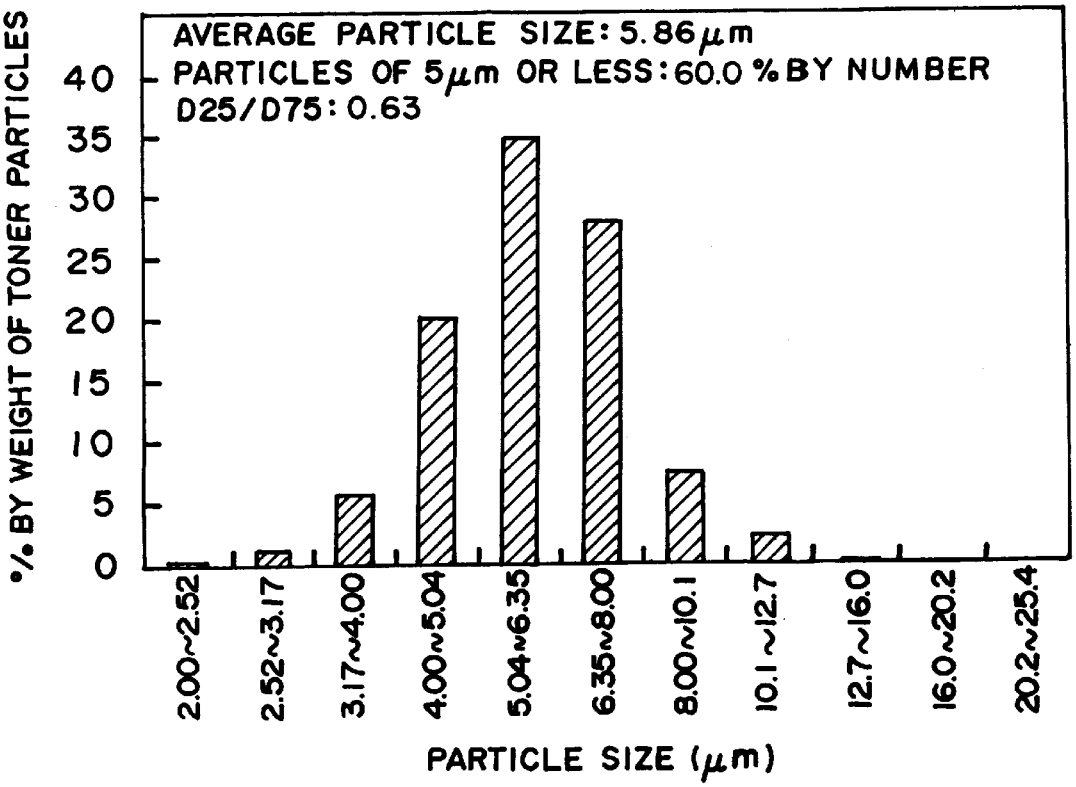
FIG. 4 is a chart showing the particle size distribution of the conventional toner shown in FIG. 3, which particle size distribution is expressed by the weight percentage.
Figure 5:
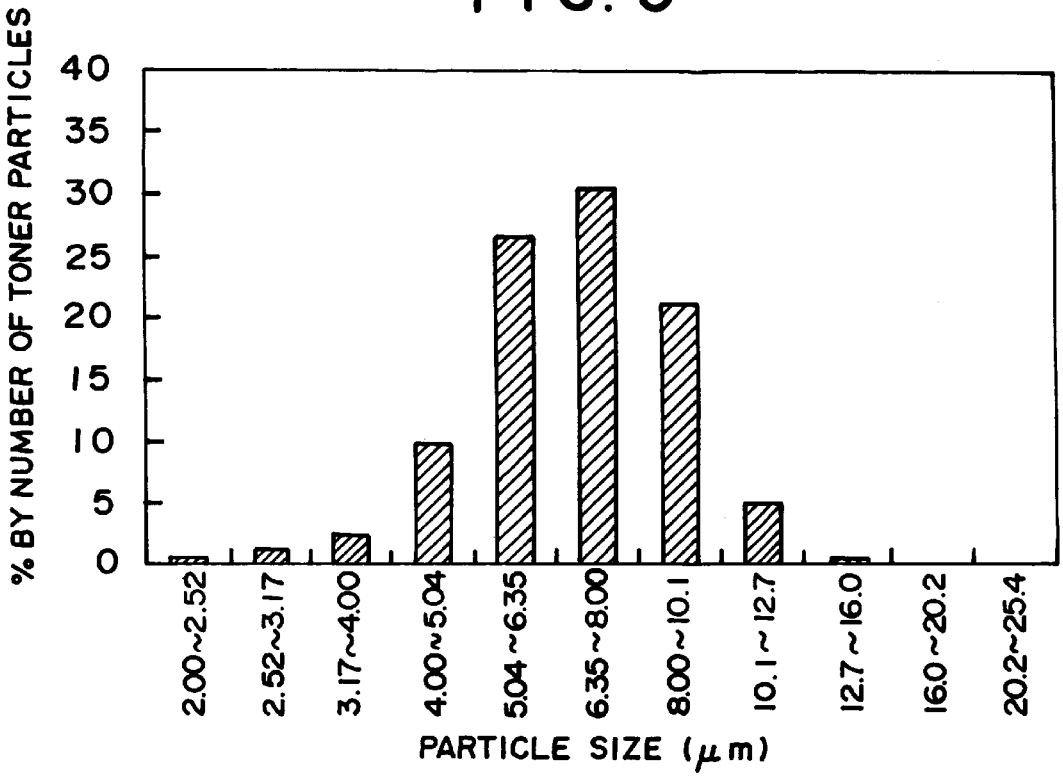
FIG. 5 is a chart showing one example of the particle size distribution of a toner according to the present invention, which particle size distribution is expressed by the percentage by number.
Figure 6:
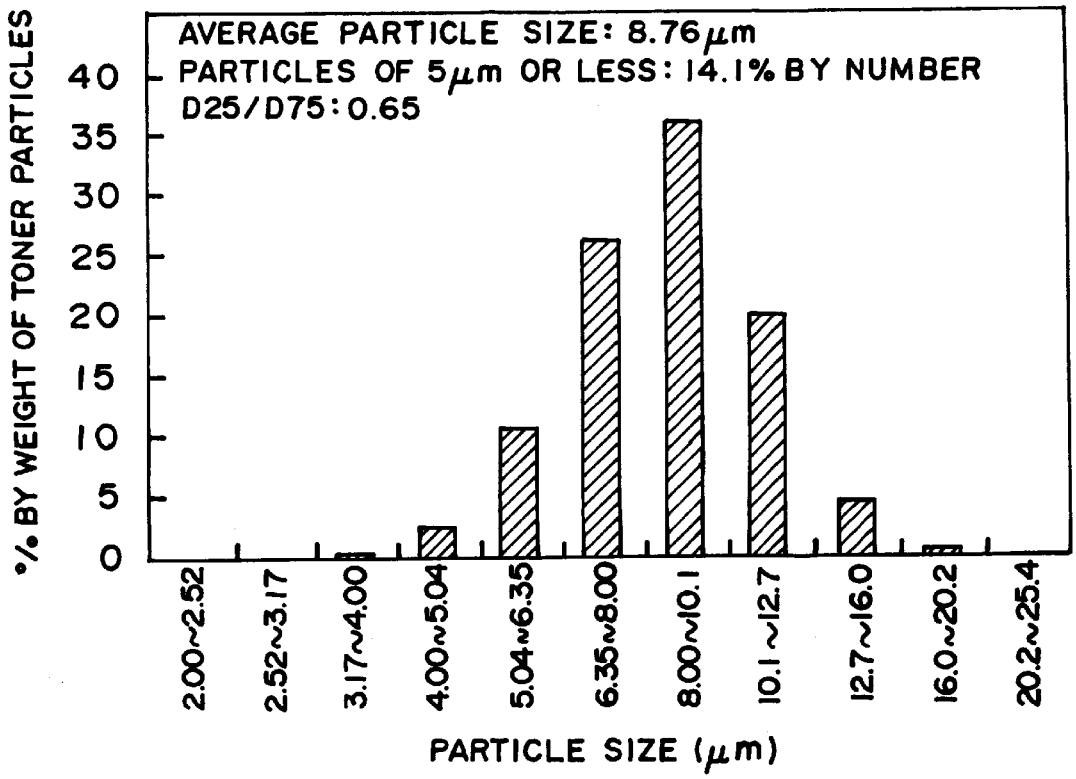
FIG. 6 is a chart showing the particle size distribution of the toner according to the present invention shown in FIG. 5, which particle size distribution is expressed by the weight percentage.

The toner of the present invention, which shows such a particle size distribution as in FIG. 5 and FIG. 6, exhibits excellent fluidity even though the amount of a fluidity imparting agent, such as finely-divided inorganic particles which have been treated to be hydrophobic is small. By using this toner, contamination of the photoconductor and the filming phenomenon on the photoconductor can be minimized, so that toner images with high resolution and high preciseness can be constantly produced when large quantities of papers are subjected to continuous copying or printing operation. Further, the quality of the obtained toner image is remarkably stable without producing the problems of the defective cleaning and the filming phenomenon even though recyclable sheets are employed.

The reason why the above-mentioned advantages can be obtained by the toner of the present invention has not been clarified, but supposed to be as follows:

One of the features of the toner according to the present invention is that the toner contains 1 to 15%, preferably 1 to 12%, and more preferably 3 to 12%, by number of toner particles with a particle diameter of 5 μm or less.

When the toner contains 15% or less by number of the fine toner particles with a particle diameter of 5 μm or less, the average particle diameter of the toner particles is relatively decreased. A small average particle diameter of tone- particles is advantageous in the formation of a toner image with high preciseness and high resolution. However, fine toner particles with a particle diameter of 5 μm or less are difficult to control the charge quantity, and likely to lower the fluidity of toner particles and contaminate the carrier. Further, those fire toner particles tend to cause the defective cleaning problem and toner filming phenomenon on the surface of the photoconductor, and tend to easily scatter to stain the inside of the image formation apparatus.

In the case where inorganic oxide powders are added to those fine toner particles for improving the fluidity, large quantities of inorganic oxide powders are needed. This is because the smaller the particle size of toner particles, the larger the entire surface area of the toner particles. Therefore, the surfaces of the fine toner particles cannot be uniformly brought into contact with the inorganic oxide powders until a large amount of inorganic oxide powders are added. It has been confirmed that the above-mentioned problems of contamination of the photoconductor, filming phenomenon, and poor image fixing performance are worsened by the addition of large quantities of fluidity imparting agent.

Namely, the increase in the content of fine toner particles with a particle diameter of 5 μm or less cannot solve the above-mentioned problems although those particles have a good effect on the improvement of the resolution in the obtained toner images. Therefore, excessive increase of those fine toner particles is considered to be disadvantageous in light of the long-term service of the toner as a two-component developer. In the present invention, the proper fluidity of toner particles can be ensured with the addition of a small amount of the fluidity imparting agent such as inorganic oxide powders because the number of toner particles with a particle diameter of 5 μm or less is controlled to 1 to 15% of the entire number of toner particles. The contamination of the photoconductor and the occurrence of filming phenomenon can be thus prevented in practice, and the image fixing performance is improved. When the weight average particle size of the toner particles is in the range of 6.0 to 11.5 μm, it is difficult to control the content of the fine toner particles with a particle diameter of 5 μm or less to 0% from the viewpoint of productivity. Therefore, the content of the fine toner particles with a particle diameter of 5 μm or less is controlled to 1% or more, preferably 3% or more in the present invention.

The second feature of the toner according to the present invention is that the number-average particle size D25 and the number-average particle size D75 are in a relationship of $0.60 \leqq D25/D75 \leqq 0.85$, more preferably $0.70 \leqq D25/D75 \leqq 0.85$. The number-average particle size D25 is a particle size obtained when the cumulative number of the toner particles reaches 25% at the measurement of a cumulative toner particle distribution by number thereof, and the number-average particle size D75 is a particle size obtained when the cumulative number of the toner particles reaches 75% at the measurement of the cumulative toner particle distribution by number thereof.

As the value of D25/D75 is closer to 1, the particle size distribution of toner particles becomes sharper within the range from 25 to 75% in the cumulative particle size distribution by number. When the particle size distribution of the toner particles within the above-mentioned range, which toner particles substantially constitute most of the toner images, is sharp, the properties of each of toner particles within the above-mentioned range can be made uniform. Owing to the uniform behavior of each toner particle in the development unit, toner images with high preciseness and high resolution can be constantly produced with minimum selective consumption of toner particles and minimum variance of charge quantity of the toner.

When the aforementioned relationship is represented by $D25/D75<0.60$, the particle size distribution becomes broad, so that the behavior of each of the toner particles becomes non-uniform. As a result, the toner particles are selectively consumed, and some toner particles provided with different charge quantities will impair the quality of the toner images. On the other hand, when the D25 and the D75 are in a relationship of $D25/D75>0.85$, the particle size distribution becomes sharp, thereby making it possible to form a toner image with remarkably high resolution. However, when such toner particles are prepared by the conventional method including dry type pulverizing and classification steps, the productivity is extremely low.

Furthermore, in the present invention, the content of toner particles whose particle diameter is twice or more the weight-average particle size is controlled to 5 wt % or less, preferably 3 wt % or less, of the total weight of the toner particles. By decreasing the content of the above-mentioned toner particles, the results become more preferable. When the toner contains the above-mentioned toner particles in an amount of more than 5 wt %, the reproducibility of a thin line image tends to decrease.

The weight-average particle size of the toner of the present invention is in the range of 6.0 to 11.5 μm, preferably in the range of 6.0 to 9.5 μm. When the weight-average particle size is less than 6.0 μm, there easily occur the problems that the inside of the image forming apparatus is contaminated due to scattering of toner particles during the long-term service, the image density decreases under the circumstances of low humidity, and the cleaning of the photoconductor is defective. When the weight-average particle size exceeds 11.5 μm, the resolution of a minute spot with a diameter of 100 μm or less is not sufficient, and the toner particles are scattering in the non-image area (background area), thereby lowering the image quality.

The toner of the present invention can exhibit the excellent performance as previously mentioned when used as a magnetic toner or a non-magnetic toner, and further, used as a mono-component developer or a two-component developer.

The two-component developer according to the present invention comprises the above-mentioned toner and a carrier comprising magnetic carrier particles. It is preferable that the average particle size of the magnetic carrier particles be in the range of 35 to 100 μm, and more preferably in the range of 45 to 75 μm. When the weight-average particle size of the magnetic carrier particles is within the above-mentioned range, the charge quantity of toner can be made more uniform under the conditions that the concentration of toner in the developer is controlled to 2 to 10 wt % in a developer unit. To be more specific, when the weight-average particle size of the carrier particles is 35 μm or more, the carrier particles can be prevented from being attracted to the photoconductor, and can be stirred with the toner particles efficiently to provide the toner with uniform charge quantity. On the other hand, when the weight-average particle size of the carrier particles is 100 μm or less, the carrier particles can charge the toner particles sufficiently, so that uniform charge quantity of toner can be obtained.

The developer of the present invention can not only solve the conventional problems, but also meet the strict requirements of the currently employed high-speed image formation apparatus, that is, the elevation of image quality, the reduction of image fixing temperature, and the improvement of durability of the employed photoconductor.

The weight-average particle size of the carrier particles can be measured by the conventional sieving method. Alternatively, 200 to 400 carrier particles are selected by random sampling from a microphotographic image taken by an optical microscope, and subjected to image processing analysis to obtain the weight-average particle size of those particles.

Although various methods are available, the particle size distribution of the toner particles is measured using a commercially available measuring apparatus "Coulter Counter Model TA II" (Trademark), made by Coulter Electronics Limited in the present invention. The particle size distributions by number and by weight are output Using the measuring apparatus of "Coulter Counter Model TA II", and analyzed using a personal computer "PC9801", made by NEC Corporation, that is connected to the "Coulter Counter Model TA II". As an electrolyte, a 1% aqueous solution of sodium chloride is prepared using a first class grade chemical of NaCl. To 10 to 15 ml of the above prepared electrolyte, 0.1 to 5 ml of a surfactant, preferably alkylbenzene sulfonate, serving as a dispersant is added, and thereafter, a sample (toner particles) in an amount of 2 to 20 mg is added. The mixture thus prepared is subjected to ultrasonic dispersion process for about 1 to 3 minutes. The dispersion thus prepared is added to 100 to 200 ml of a 1% aqueous solution of sodium chloride separately prepared in a beaker to obtain a predetermined concentration of the sample dispersion. Then, by means of the "Coulter Counter Model TA II" provided with an aperture of 100 μm, the particle distribution of toner particles with a particle size ranging from 2 to 40 μm is measured using 50,000 particles. The distributions of those particles by weight and by number are calculated. From the particle distribution by weight, the weight-average particle size is obtained.

To prepare a two-component developer of the present invention, it is desirable to add finely-divided inorganic particles as a fluidity imparting agent to the toner. In the toner having such particle size distribution as specified in the present invention, the specific surface area of the toner is smaller than that of the conventional toner. Therefore, when the toner of the present invention is mixed with a magnetic carrier to prepare a two-component developer, the possibility of bringing the toner particles in contact with the carrier particles is decreased as compared with the case of the conventional two-component developer. As a result, the carrier particles can be prevented from being contaminated with the toner, and the toner particles can be prevented from being abraded and crushed.

Further, with the decrease in the specific surface area of the toner, the amount of finely-divided inorganic particles added to the toner as the fluidity imparting agent can be decreased. Accordingly, it is possible to minimize the contamination of the photoconductor with the finely-divided inorganic particles, the filming phenomenon, and defective image fixing. Therefore, the life of the developer and that of the photoconductor can be extended.

The toner particles with a number-average particle size ranging from D25 to D75, which play a significant role, can exhibit their function more effectively when used in combination with a small amount of the finely-divided inorganic particles, thereby steadily providing high quality toner image for an extended period of time.

As the finely-divided inorganic particles serving as the fluidity imparting agent for use in the present invention, oxides and composite oxides comprising Si, Ti, Al, Mg, Ca, Sr, Ba, In, Ga, Ni, Mn, W, Fe, Co, Zn, Cr, Mo, Cu, Ag, V, and Zr are useful. Of the above-mentioned inorganic powders, finely-divided particles of silicon dioxide (silica), titanium dioxide (titania) and aluminum oxide (alumina) are particularly preferable.

Further, the above-mentioned inorganic powders may be surface-treated to make those powders hydrophobic. Examples of the surface treatment agent for making the inorganic powders hydrophobic are as follows: dimethyldichlorosilane, trimehtylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyltrichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, and hexatolyldisilazane. In addition, a titanate based coupling agent and an aluminum based coupling agent can also be employed.

It is preferable that the amount of inorganic powders be in the range of 0.1 to 2 wt % of the entire weight of the toner. When the amount of inorganic powders is less than 0.1 wt %, aggregation of toner particles cannot be effectively prevented. When the amount of inorganic powders exceeds 2 wt %, the toner particles tend to scatter between thin line images, the inside of the image forming apparatus tends to be stained with toner particles, and the photoconductor is easily damaged or abraded. In the present invention, even though the amount of inorganic powders is small, the predetermined fluidity of toner can be ensured. As a result, high quality images with high resolution can be constantly produced when large quantities of copies are made for a long period of time. The present invention is obviously effective as compared with the case where the amount of toner particles with a particle diameter of 5 μm or less is increased and a large quantity of inorganic powders is added.

The developer of the present invention may further comprise other additives as long as they have an adverse effect on the developer. For instance, there can be employed a small amount of lubricant such as finely-divided particles of Teflon, zinc stearate, and polyvinylidene fluoride; an abrasive such as finely-divided particles of cerium oxide, silicon carbide and strontium titanate; an electroconductivity imparting agent Such as finely-divided particles of carbon black, zinc oxide and tin oxide; and an agent for improving development performance such as finely-divided white powders and black powders, each having a polarity opposite to that of the toner.

As the binder resins for use in the toner of the present, any binder resins used in the conventional toners are usable. A vinyl resin, a polyester resin, or a polyol resin is preferably employed as the binder resin.

Specific examples of the vinyl resin used as the binder resin for use in the toner include homopolymers of styrene and substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ether copolymer, styrene-vinylmethyl ether copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer; and poly(methyl methacrylate), poly(butyl methacrylate), polyvinyl chloride, and polyvinyl acetate.

The polyester resin serving as the binder resin in the present invention is prepared from a dihydroxy alcohol component (a) selected from the following group A and a dibasic acid component (b) selected from the following group B. Furthermore, a polyhydric alcohol having three or more hydroxyl groups, or a polycarboxylic acid having three or more carboxyl groups selected from the following group C may be added to the above-mentioned components (a) and (b).

Group A: ethylene glycol, triethylene glycol, 1,2 - propylene glycol, 1,3-propylene glycol, 1,4-butanediol, neopentyl glycol, 1,4-butenediol, 1,4-bis(hydroxymethyl) cyclohexane, bisphenol A, hydrogenated bisphenol A, a reaction product of polyoxyethylene and bisphenol A, polyoxypropylene(2,2)-2,2'-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, and polyoxypropylene(2,0)-2,2'-bis(4-hydroxyphenyl) propane.

Group B: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, linolenic acid; anhydrides of the above acids; and esters of the above acids and a lower alcohol.

Group C: polyhydric alcohols having three or more hydroxyl groups, such as glycerin, trimethylolpropane, and pentaerythritol; and polycarboxylic acids having three or more carboxyl groups, such as trimellitic acid and pyromellitic acid.

The polyol resin which is preferably used as the binder resin in the toner of the present invention, is prepared by allowing the following components to react: (1) an epoxy resin; (2) an alkylene oxide adduct of a dihydric phenol or a glycidyl ether of the alkylene oxide adduct; (3) a compound having in the molecule thereof one active hydrogen atom which is capable of reacting with epoxy group; and (4) a compound having in the molecule thereof two or more active hydrogen atoms which are capable of reacting with epoxy group.

The above-mentioned resins may be used together with other resins, for example, epoxy resin, polyamide resin, urethane resin, phenolic resin, butyral resin, rosin, modified rosin, and terpene resin when necessary.

As the aforementioned epoxy resin for use in the present invention, a polycondensation product of a bisphenol such as bisphenol A or bisphenol F and epichlorohydrin is representative.

The coloring agent for use in the toner of the present invention includes a variety of pigments.

Examples of the black coloring agent are carbon black, oil furnace black, channel black, lamp back, acetylene black, Azine dyes such as aniline black, metallic salt azo dyes, metallic oxides, and composite metallic oxides.

Examples of the yellow pigment are Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake.

Examples of the orange pigment are Molybdate Orange, Permanent Orange GTR, Pyrazolone Orange, Vulcan Orange, Indanthrene Brilliant Orange RK, Benzidine Orange G, and Indanthrene Brilliant Orange GK.

Examples of the red pigment are red iron oxide, Cadmium Red, Permanent Red 4R, Lithol Red, Pyrazolone Red, Watchung Red Calcium Salt, Lake Red D, Brilliant Carmine 6B, Eosine Lake, Rhodamine Lake B, Alizarine Lake, and Brilliant Carmine 3B.

Examples of the purple pigment are Fast Violet B and Methyl Violet Lake.

Examples of the blue pigment are Cobalt Blue, Alkali Blue, Victoria Blue Lake, Phthalocyanine Blue, metal-free Phthalocyanine Blue, Phthalocyanine Blue partially chlorinated, Fast Sky Blue and Indanthrene Blue BC.

Examples of the green pigment are Chrome Green, chromium oxide, Pigment Green B, and Malachite Green Lake.

These pigments can be employed alone or in combination.

Further, any conventional dyes may be used as the coloring agents in the present invention.

The toner of the present invention may further comprise a releasing agent for inhibiting the off-set phenomenon in the image fixing process. The releasing agent may be internally added to the toner composition.

Examples of the releasing agent include natural waxes such as candelilla wax, carnauba wax, and rice wax; montan wax, paraffin wax, sazol wax, low-molecular-weight polyethylene, low-molecular-weight polypropylene, and alkyl phosphate.

The releasing agent may be determined depending upon the kind of binder resin for use in the toner and the kind of material used for the surface portion of the image fixing roller. It is preferable that the melting point of the employed releasing agent be in the range of 65 to 90° C. When the melting point of the releasing agent is within the above-mentioned range, blocking of toner particles can be prevented during the storage thereof, and the off-set phenomenon does not easily take place when the image fixing roller is in a low temperature region.

The two-component developer according to the present invention may further comprise a charge control agent. The charge control agent may be incorporated in the toner particles (internal addition), or may be mixed with the toner particles (external addition) The charge control agent makes it possible to appropriately control the charge quantity of toner depending on the employed development system. By the addition of the charge control agent, the balance between the charge quantity of toner and the particle size distribution can be stabilized.

Specific examples of the positive charge control agent are nigrosine, quaternary ammonium salts, and imidazole metal complexes and salts thereof; and specific examples of the negative charge control agent are salicylic acid metal complexes and salts thereof, organic boron salts, and calixarene compounds.

In the case where the toner of the present invention is employed as a magnetic toner, finely-divided particles of a magnetic material may be dispersed in the toner particle.

Examples of the magnetic material include ferromagnetic metals, such as iron, nickel and cobalt, and alloys and compounds comprising the above-mentioned elements, such as ferrite and magnetite; alloys capable of exhibiting ferromagnetism by proper heat treatment although the ferromagnetic elements are not contained, such as the so-called Heusler's alloys comprising manganese and copper (a manganese-copper-aluminum alloy, and a manganese-copper-tin alloy); and chromium dioxide.

It is preferable that the magnetic material be in the form of finely-divided particles with an average particle size of 0.1 to 1 $\mu$m. Those magnetic particles may be uniformly dispersed in the toner composition. It is preferable that the amount of magnetic material be in the range of 10 to 70 parts by weight, more preferably in the range of 20 to 50 parts by weights, with respect to 100 parts by weight of the obtained toner.

With respect to the carrier for use in the two-component developer of the present invention, there can be used any materials for the conventional carriers. For example, magnetic powders such as iron powder, ferrite powder, nickel powder, and magnetite powder are useful, and these magnetic powders may be surface-treated with a fluorine-containing resin, vinyl resin or silicone resin. In addition, resin particles prepared by dispersing the magnetic powders in a resin are also employed as the carrier particles. It is proper that the weight-average particle size of the magnetic carrier particles be in the range of 35 to 75 $\mu$m.

A toner according to the present invention can be prepared, for example, by sufficiently mixing the above-mentioned binder resin, pigment or dye serving as the coloring agent, lubricant, and other additives using a mixer such as a Henschel mixer, and thoroughly kneading the mixture.

As a kneading apparatus, the following kneaders can be appropriately employed: a batch-type two-roll mixer, Banburry's mixer, a continuous double screw extruder such as a KTK type double screw extruder made by Kobe Steel, Ltd., a TEM type double screw extruder made by Toshiba Machine Co., Ltd., a double screw extruder made by KCK Co., Ltd., a PCM type double screw extruder made by Ikegai Tekko Co., Ltd., a KEX type double screw extruder made by Kurimoto, Ltd., and a continuous single screw kneader, for example, Continuous Kneader made by Buss Co., Ltd.

After the thus kneaded mixture is cooled, the mixture is coarsely crushed by a hammer mill, and thereafter finely pulverized by means of a pulverizer using jet air stream or a mechanical pulverizer, and classified to obtain a predetermined particle size using a rotary air classifier or a classifier utilizing a Coanda effect.

Then, the classified particles are sufficiently mixed with the above-mentioned finely-divided inorganic particles in a mixer such as a Henschel mixer, and the obtained particles are caused to pass through a sieve with 250-mesh or more to remove the coarse particles and the aggregated particles. Thus, a toner according to the present invention is obtained. Further, the thus obtained toner and the above-mentioned magnetic carrier are mixed at a predetermined mixing ratio, so that a two-component developer according to the present invention is obtained.

Other features of this invention will become apparent in the course of the following description of exemplary embodiments, which are given for illustration of the invention and are not intended to be limiting thereof.

EXAMPLE 1

The following components were sufficiently mixed in a mixer.

| | Parts by Weight |
|---|---|
| Binder resin: polyol resin | 100 |
| Coloring agent: carbon black | 10 |
| Charge control agent: zinc salicylate | 5 |
| Releasing agent: low molecular weight polyethylene | 5 |

The resultant mixture was fused and kneaded at 120° C. using a double-screw extruder. After the kneaded mixture was rolled and cooled, the mixture was coarsely crushed by a cutter mill and finely pulverized by means of a pulverizer using jet air stream. Thereafter, the particles were subjected to air classification so as to obtain such particle size distribution as shown in TABLE 1. Thus, matrix toner particles were prepared.

100 parts by weight of the matrix toner particles were mixed with 0.3 parts by weight of hydrophobic silica particles in a Henschel mixer, whereby a toner (1) according to the present invention was obtained.

To evaluate the fluidity of the toner (1), the loose bulk density and the cohesiveness were measured using a commercially available powder characteristics tester "Powder Tester PT-N" (Trademark), made by Hosokawa Micron Corporation. The loose bulk density was measured by screening the toner particles. To be more specific, the toner particles passing through a 250-mesh screen and going to a hopper were collected and weighed. The loose bulk density was calculated from the weight thus obtained. On the other hand, the cohesiveness was measured by subjecting the toner particles to screening using the standard sieves of 150-μm mesh, 75-μm mesh, and 45-μm mesh, with the application of vibration for 60 sec. Then, the cohesiveness was calculated in accordance with the following formula:

$$\text{Cohesiveness}(\%) = \left[\begin{matrix}\text{(remaining}\\\text{amount on}\\\text{150 }\mu\text{m sieve)}\end{matrix} + 3\times\frac{\begin{matrix}\text{(remaining}\\\text{amount on}\\\text{75 }\mu\text{m sieve)}\end{matrix}}{5} + \frac{\begin{matrix}\text{(remaining}\\\text{amount on}\\\text{45 }\mu\text{m sieve)}\end{matrix}}{5}\right]\times 50$$

2.5 parts by weight of the toner particles of the toner (1) were mixed with 97.5 parts by weight of carrier particles prepared by coating ferrite particles with a silicone resin, whereby a two-component developer No. 1 according to the present invention was obtained. The weight-average particle size of the above-mentioned carrier particles was 100 μm.

The thus obtained two-component developer No. 1 was set in a commercially available copying apparatus "imagio DA505" (Trademark), made by Ricoh Company, Ltd., which was provided with an organic photoconductor drum as the latent image bearing member and a cleaning blade as the cleaning means.

Then, the following evaluation tests were carried out.

(1) Image Fixing Performance 100 copies of a solid image were made with the image fixing temperature of the copying apparatus being set to a core temperature within the originally designated image fixing temperature range and a temperature lower than the above-mentioned designated image fixing temperature by 30° C.

After making of 100 copies, the two solid image samples produced at different image fixing temperatures were subjected to scratch test using a commercially available tester. Each solid image was rubbed with a needle with the application of a load of 50 g thereto, and thereafter the remaining scratch was visually observed.

The image fixing performance was evaluated on the scale from 1 to 5. The greater the scale value, the better the image fixing performance. The scale value of less than 3 is regarded as unacceptable for practical use. This is because such a remaining image sample is easily peeled off when rubbed with an eraser. Image fixing performance is excellent at the scale value of 5.

(2) Cleaning Performance and Filming Phenomenon

After making of 100 copies and 800,000 copies, it was checked whether the residual toner particles on the surface of the photoconductor were perfectly cleaned or not, and the filming phenomenon occurred or not.

(3) Resolution of Image

Using a standard resolving power test chart (S-3), the reproduced thin line image was observed using a test glass.

The resolution of image was evaluated on the scale from 1 to 5. The smaller the scale value, the poorer the reproducibility of a thin line image. At the scale 5, a thin line image is very faithfully reproduced. The scale 3 or less is regarded as unacceptable for practical use because of the poor resolving power.

(4) Abrasion Resistance of Photoconductor

The decrease in thickness of the photoconductor was obtained. To be more specific, the thickness of the photoconductor was measured at 30 points thereof using an eddy-current type film thickness measuring apparatus before and after the running test of 800,000 copies. The decrease in film thickness on the average was obtained.

The evaluation results are shown in TABLE 2.

EXAMPLE 2

The procedure for preparation of the two-component developer in Example 1 was repeated except that the weight-average particle size of the employed carrier particles was changed from 100 μm to 30 μm.

Thus, a two-component developer No. 2 according to the present invention was obtained.

The two-component developer No. 2 was evaluated in the same manner as in Example 1.

The evaluation results are shown in TABLE 2.

EXAMPLE 3

The procedure for preparation of the two-component developer in Example 1 was repeated except that the weight-average particle size of the employed carrier particles was changed from 100 μm to 50 μm.

Thus, a two-component developer No. 3 according to the present invention was obtained.

The two-component developer No. 3 was evaluated in the same manner as in Example 1.

The evaluation results are shown in TABLE 2.

EXAMPLE 4

The procedure for preparation of the toner (1) in Example 1 was repeated except that the conditions of classification were changed so as to obtain such a particle size distribution as shown in TABLE 1, and that the amount of hydrophobic silica was changed from 0.3 to 0.5 parts by weight. Thus, a toner (2) of the present invention was prepared.

Using the toner (2) and the same carrier as employed in Example 3, a two-component developer No. 4 according to the present invention was obtained.

The two-component developer No. 4 was evaluated in the same manner as in Example 1.

The evaluation results are shown in TABLE 2.

EXAMPLE 5

The procedure for preparation of the toner (1) in Example 1 was repeated except that the conditions of classification were changed so as to obtain such a particle size distribution as shown in TABLE 1, and that the amount of hydrophobic silica was changed from 0.3 to 0.5 parts by weight. Thus, a toner (3) of the present invention was prepared.

Using the toner (3) and the same carrier as employed in Example 3, a two-component developer No. 5 according to the present invention was obtained.

The two-component developer No. 5 was evaluated in the same manner as in Example 1.

The evaluation results are shown in TABLE 2.

EXAMPLE 6

The procedure for preparation of the toner (1) in Example 1 was repeated except that the conditions of classification were changed so as to obtain such a particle size distribution as shown in TABLE 1, and that the amount of hydrophobic silica was changed from 0.3 to 0.5 parts by weight. Thus, a toner (4) of the present invention was prepared.

Using the toner (4) and the same carrier as employed in Example 3, a two-component developer No. 6 according to the present invention was obtained.

The two-component developer No. 6 was evaluated in the same manner as in Example 1.

The evaluation results are shown in TABLE 2.

EXAMPLE 7

The following components were sufficiently mixed in a mixer.

| | Parts by Weight |
|---|---|
| Binder resin: styrene-methyl acrylate copolymer | 100 |
| Coloring agent: carbon black | 10 |
| Charge control agent: nigrosine | 5 |

The resultant mixture was fused and kneaded at 110° C. using a double-screw extruder After the kneaded mixture was rolled and cooled, the mixture was coarsely crushed by a cutter mill and finely pulverized by means of a pulverizer using jet air stream. Thereafter, the particles were subjected to air classification so as to obtain such a particle size distribution as shown in TABLE 1. Thus, matrix toner particles were prepared.

100 parts by weight of the matrix toner particles were mixed with 0.3 parts by weight of hydrophobic silica particles in a Henschel mixer, whereby a toner (5) according to the present invention was obtained.

Using the toner (5) and the same carrier as employed in Example 1, a two-component developer No. 7 according to the present invention was obtained.

The thus obtained two-component developer No. 7 was set in a commercially available copying apparatus "FT9001II" (Trademark), made by Ricoh Company, Ltd., which was provided with an organic photoconductor in the form of a belt as the latent image bearing member and a magnetic brush as the cleaning means.

Then, the above-mentioned evaluation tests were carried out in the same manner as in Example 1.

The evaluation results are shown in TABLE 2.

EXAMPLE 8

The procedure for preparation of the toner (5) in Example 7 was repeated except that the conditions of classification were changed so as to obtain such a particle size distribution as shown in TABLE 1. Thus, a toner (6) of the present invention was prepared.

Using the toner (6) and the same carrier as employed in Example 1, a two-component developer No. 8 according to the present invention was obtained.

The two-component developer No. 8 was evaluated in the same manner as in Example 7.

The evaluation results are shown in TABLE 2.

EXAMPLE 9

The following components were sufficiently mixed in a mixer.

| | Parts by Weight |
|---|---|
| Binder resin: polyester resin | 100 |
| Coloring agent: quinacridone based magenta pigment (C.I. Pigment Red 122) | 8 |
| Charge control agent: zinc salicylate | 3 |

The resultant mixture was fused and kneaded at 120° C. using a double-screw extruder. After the kneaded mixture was rolled and cooled, the mixture was coarsely crushed by a cutter mill and finely pulverized by means of a pulverizer using jet air stream. Thereafter, the particles were subjected to air classification so as to obtain such a particle size distribution as shown in TABLE 1. Thus, matrix toner particles were prepared.

100 parts by weight of the matrix toner particles were mixed with 0.3 parts by weight of hydrophobic silica particles in a Henschel mixer, whereby a toner (7) according to the present invention was obtained.

Using the color toner (7) and the same carrier as employed in Example 3, a two-component developer No. 9 according to the present invention was obtained.

The thus obtained two-component developer No. 9 was set in a commercially available full-color copying apparatus "PRETER 550" (Trademark), made by Ricoh Company, Ltd.

Then, the evaluation tests were carried out in the same manner as in Example 1.

The evaluation results are shown in TABLE 2.

Figure 7:
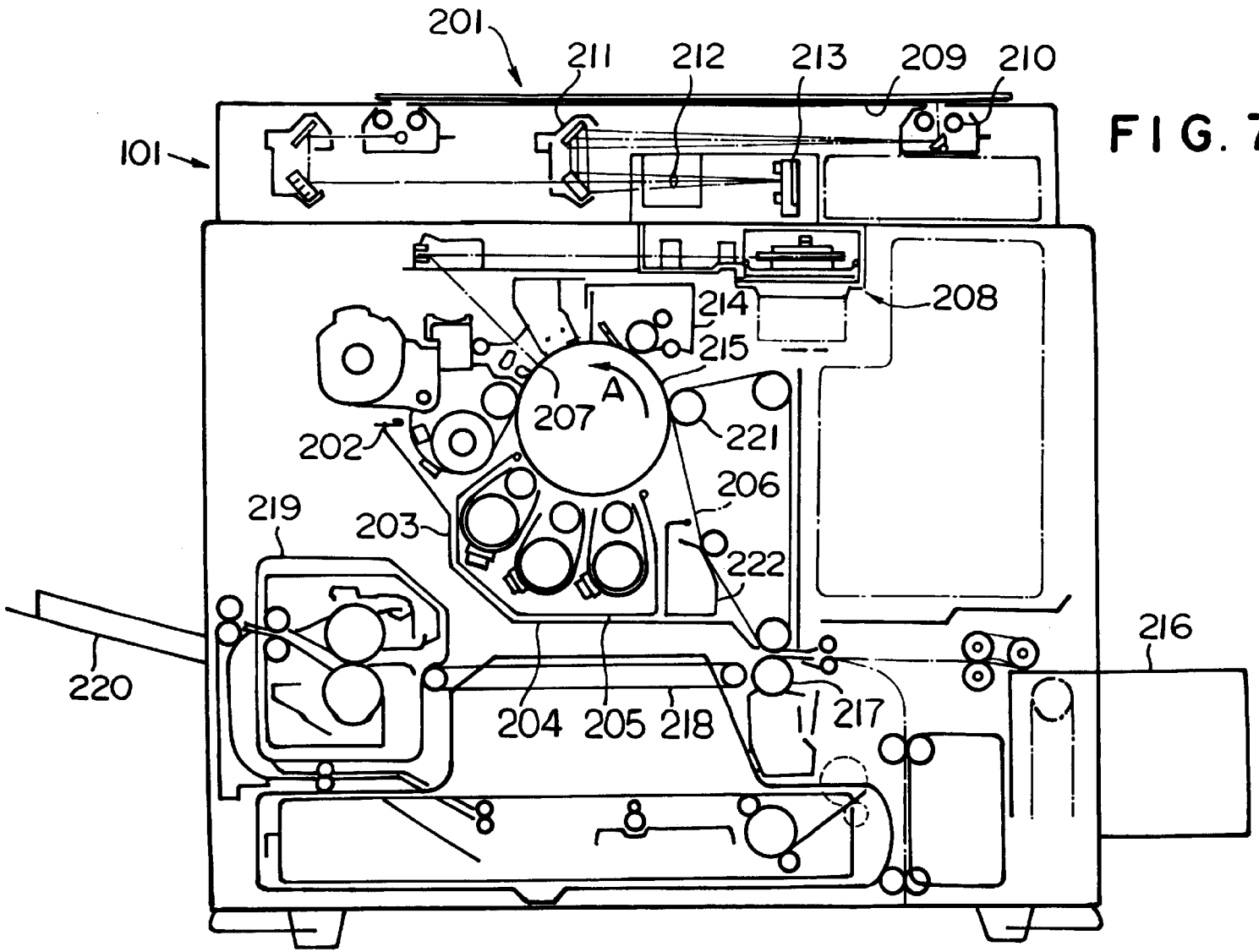
FIG. 7 is a cross-sectional schematic view of a full-color copying machine employed in Example 9.

FIG. 7 is a schematic cross-sectional view of the above-mentioned full-color copying apparatus. In FIG. 7, reference numeral 101 indicates a scanner; reference numeral 201, a copying apparatus; reference numeral 202, a black development unit; reference numeral 203, a cyan development unit; reference numeral 204, a magenta development unit; reference numeral 205, a yellow development unit; reference numeral 206, an intermediate image transfer belt; reference numeral 207, a charging unit; reference numeral 208, an optical laser system; reference numeral 209, a contact glass; reference numeral 210, an exposure lamp (halogen lamp); reference numeral 211, a reflector; reference numeral 212, an image formation lens; reference numeral 213, a CCD image sensor; reference numeral 214, a cleaning unit; reference numeral 215, a photoconductor; reference numeral 216, a paper feed unit; reference numeral 217, an image transfer bias roller; reference numeral 218, a transporting belt; reference numeral 219, an image fixing unit; reference numeral 220, a paper discharge tray; reference numeral 221, a bias roller; and reference numeral 222, a belt cleaning unit.

EXAMPLE 10

The following components were sufficiently mixed in a mixer.

| | Parts by Weight |
|---|---|
| Binder resin: polyester resin | 100 |
| Coloring agent: copper phthalocyanine blue pigment (C.I. Pigment Blue 15:3) | 3.5 |
| Charge control agent: zinc salicylate | 5 |

The resultant mixture was fused and kneaded at 120° C. using a double-screw extruder After the kneaded mixture was rolled and cooled, the mixture was coarsely crushed by a cutter mill and finely pulverized by means of a pulverizer using jet air stream. Thereafter, the particles were subjected to air classification so as to obtain such a particle size distribution as show in TABLE 1. Thus, matrix toner particles were prepared.

100 parts by weight of the matrix toner particles were mixed with 0.3 parts by weight of hydrophobic silica particles in a Henschel mixer, whereby a toner (8) according to the present invention was obtained.

The thus obtained toner (8), that is, a mono-component color developer was set in a commercially available printer "SP10PS ProII" (Trademark), made by Ricoh Company, Ltd.

Then, the evaluation tests were carried out in the same manner as in Example 1.

The evaluation results are shown in TABLE 2.

EXAMPLE 11

The following components were sufficiently mixed in a mixer.

| | Parts by Weight |
|---|---|
| Binder resin: styrene-methyl acrylate copolymer | 100 |
| Magnetic material: $Fe_2O_3$ | 80 |
| Charge control agent: zinc salicylate | 4 |

The resultant mixture was fused and kneaded at 120° C. using a double-screw extruder. After the kneaded mixture was rolled and cooled, the mixture was coarsely crushed by a cutter mill and finely pulverized by means of a pulverizer using jet air stream. Thereafter, the particles were subjected to air classification so as to obtain such a particle size distribution as shown in TABLE 1. Thus, matrix toner particles were prepared.

100 parts by weight of the matrix toner particles were mixed with 0.3 parts by weight of hydrophobic silica particles in a Henschel mixer, whereby a magnetic toner (9) according to the present invention was obtained.

The thus obtained magnetic toner (9), that is, a mono-component developer was set in a commercially available printer "SP10PS ProII" (Trademark), made by Ricoh Company, Ltd.

Then, the evaluation tests were carried out in the same manner as in Example 1.

The evaluation results are shown in TABLE 2.

Comparative Example 1

The procedure for preparation of the toner (1) in Example 1 was repeated except that the conditions of classification were changed so as to obtain such a particle size distribution as shown in TABLE 1, and that the amount of hydrophobic silica was changed from 0.3 to 0.5 parts by weight. Thus, a toner (10) was prepared.

Using the thus prepared comparative toner (10) and the same carrier as employed in Example 3, a comparative two-component developer No. 1 was obtained.

The comparative two-component developer No. 1 was evaluated in the same manner as in Example 1.

The evaluation results are shown in TABLE 2.

Comparative Example 2

The procedure for preparation of the toner (1) in Example 1 was repeated except that the conditions of classification were changed so as to obtain such a particle size distribution as shown in TABLE 1, and that the amount of hydrophobic silica was changed from 0.3 to 0.7 parts by weight. Thus, a toner (11) was prepared.

Using the thus prepared comparative toner (11) and the same carrier as employed in Example 3, a comparative two-component developer No. 2 was obtained.

The comparative two-component developer No. 2 was evaluated in the same manner as in Example 1.

The evaluation results are shown in TABLE 2.

Comparative Example 3

The procedure for preparation of the toner (1) in Example 1 was repeated except that the conditions of classification were changed so as to obtain such a particle size distribution as shown in TABLE 1, and that the amount of hydrophobic silica was changed from 0.3 to 3.0 parts by weight Thus, a toner (12) was prepared.

Using the thus prepared comparative toner (12) and the same carrier as employed in Example 3, a comparative two-component developer No. 3 was obtained.

The comparative two-component developer No. 3 was evaluated in the same manner as in Example 1.

The evaluation results are shown in TABLE 2.

Comparative Example 4

The procedure for preparation of the toner (1) in Example 1 was repeated except that the conditions of classification were changed so as to obtain such a particle size distribution as shown in TABLE 1, and that the amount of hydrophobic silica was changed from 0.3 to 1.0 parts by weight. Thus a toner (13) was prepared.

Using the thus prepared comparative toner (13) and the same carrier as employed in Example 3, a comparative two-component developer No. 4 was obtained.

The comparative two-component developer No. 4 was evaluated in the same manner as in Example 1.

The evaluation results are shown in TABLE 2.

Comparative Example 5

The procedure for preparation of the toner (1) in Example 1 was repeated except that the conditions of classification were changed so as to obtain such a particle size distribution as shown in TABLE 1. Thus, a toner (14) was prepared.

Using the thus prepared comparative toner (14) and the same carrier as employed in Example 3, a comparative two-component developer No. 5 was obtained.

The comparative two-component developer No. 5 was evaluated in the same manner as in Example 1.

The evaluation results are shown in TABLE 2.

Comparative Example 6

The procedure for preparation of the toner (1) in Example 1 was repeated except that the conditions of classification were changed so as to obtain such a particle size distribution as shown in TABLE 1. Thus, a toner (15) was prepared.

Using the thus prepared comparative toner (15) and the same carrier as employed in Example 3, a comparative two-component developer No. 6 was obtained.

The comparative two-component developer No. 6 was evaluated in the same manner as in Example 1.

The evaluation results are shown in TABLE 2.

Comparative Example 7

The procedure for preparation of the toner (1) in Example 1 was repeated except that the conditions of classification were changed so as to obtain such a particle size distribution as shown in TABLE 1. The yield of matrix toner particles was as low as 21% under the above-mentioned classification conditions, which yield was not considered to be acceptable for practical use.

0.3 parts by weight of hydrophobic silica particles were mixed with 100 parts by weight of the above-mentioned matrix toner particles. Thus, a toner (16) was prepared.

Using the thus prepared comparative toner (16) and the same carrier as employed in Example 3, a comparative two-component developer No. 7 was obtained.

The comparative two-component developer No. 7 was evaluated in the same manner as in Example 1.

The evaluation results are shown in TABLE 2.

Comparative Example 8

The procedure for preparation of the toner (5) in Example 7 was repeated except that the conditions of classification were changed so as to obtain such a particle size distribution as shown in TABLE 1. Thus, a toner (17) was prepared.

Using the thus prepared comparative toner (17) and the same carrier as employed in Example 1, a comparative two-component developer No. 8 was obtained.

The comparative two-component developer No. 8 was evaluated in the same manner as in Example 7.

The evaluation results are shown in TABLE 2.

Comparative Example 9

The procedure for preparation of the comparative toner (17) in Comparative Example 8 was repeated except that the amount of hydrophobic silica was changed from 0.3 to 0.6 parts by weight. Thus, a toner (18) was prepared.

Using the thus prepared comparative toner (18) and the same carrier as employed in Example 1, a comparative two-component developer No. 9 was obtained.

The comparative two-component developer No. 9 was evaluated in the same manner as in Example 7.

The evaluation results are shown in TABLE 2.

TABLE 1

| | Particle Size Distribution of Toner | | | | | Characteristics of Carrier | |
|---|---|---|---|---|---|---|---|
| | Weight-average particle size (μm) | Content ratio (%) by number of toner particles (a)* | D25/D75 | Content ratio (%) by weight of toner particles (b)** | Amount of Inorganic Powder (parts by weight) | Weight-average particle size (μm) | Yield of Toner Particles (%) |
| Ex. 1 | 9.93 | 15.0 | 0.63 | 4.3 | 0.3 | 100 | 83 |
| Ex. 2 | 9.93 | 15.0 | 0.63 | 4.3 | 0.3 | 30 | 83 |
| Ex. 3 | 9.93 | 15.0 | 0.63 | 4.3 | 0.3 | 50 | 83 |
| Ex. 4 | 8.51 | 15.0 | 0.68 | 2.2 | 0.5 | 50 | 80 |
| Ex. 5 | 8.47 | 12.1 | 0.71 | 1.5 | 0.5 | 50 | 79 |
| Ex. 6 | 8.38 | 7.2 | 0.82 | 0.3 | 0.5 | 50 | 77 |
| Ex. 7 | 10.00 | 14.8 | 0.63 | 3.7 | 0.3 | 100 | 80 |
| Ex. 8 | 9.81 | 3.2 | 0.74 | 1.5 | 0.3 | 100 | 71 |
| Ex. 9 | 9.69 | 14.9 | 0.63 | 4.2 | 0.3 | 50 | 83 |
| Ex. 10 | 9.86 | 14.8 | 0.64 | 4.1 | 0.3 | — | 83 |
| Ex. 11 | 9.91 | 15.0 | 0.63 | 4.3 | 0.3 | — | 65 |
| Comp. Ex. 1 | 8.51 | 23.5 | 0.65 | 1.7 | 0.5 | 50 | 81 |
| Comp. Ex. 2 | 8.51 | 23.5 | 0.65 | 1.7 | 0.7 | 50 | 81 |
| Comp. Ex. 3 | 5.38 | 70.0 | 0.67 | 0.3 | 3.0 | 50 | 91 |
| Comp. Ex. 4 | 5.38 | 70.0 | 0.67 | 0.3 | 1.0 | 50 | 91 |
| Comp. Ex. 5 | 10.01 | 14.6 | 0.72 | 8.1 | 0.3 | 50 | 83 |
| Comp. Ex. 6 | 10.34 | 15.0 | 0.59 | 0.7 | 0.3 | 50 | 80 |
| Comp. Ex. 7 | 8.98 | 0.3 | 0.87 | 0.0 | 0.3 | 50 | 21 |
| Comp. Ex. 8 | 10.01 | 37.0 | 0.58 | 4.4 | 0.3 | 100 | 85 |
| Comp. Ex. 9 | 10.01 | 37.0 | 0.58 | 4.4 | 0.6 | 100 | 85 |

(*) Toner particles (a) have a particle size of 5 μm or less.
(**) Toner particles (b) have a particle size of twice or more the weight-average particle size.

TABLE 2

| | | Fluidity of Toner | | Image Fixing Performance | | Initial Stage (After producing 100 sheets) | | After Producing 800,000 Sheets | | | |
|---|---|---|---|---|---|---|---|---|---|---|---|
| | Toner No. | Loose bulk density (g/cm³) | Cohesiveness (%) | Image fixing Temp. (1)* | Image fixing Temp. (2)** | Defective cleaning | Filming phenomenon | Defective cleaning | Filming phenomenon | Image resolution | Decrease in thickness of photoconductor (μm) |
| Ex. 1 | 1 | 0.393 | 3.08 | 5 | 4.5 | None | None | None | None | 4.5 | 6.1 |
| Ex. 2 | 1 | 0.393 | 3.08 | 5 | 4.5 | None | None | None | None | 4.5 | 7.0 |
| Ex. 3 | 1 | 0.393 | 3.08 | 5 | 4.5 | None | None | None | None | 5 | 6.3 |
| Ex. 4 | 2 | 0.372 | 3.19 | 5 | 4.5 | None | None | None | None | 5 | 7.5 |
| Ex. 5 | 3 | 0.376 | 3.18 | 5 | 4.5 | None | None | None | None | 5 | 7.5 |
| Ex. 6 | 4 | 0.0381 | 3.17 | 5 | 4.5 | None | None | None | None | 5 | 7.5 |
| Ex. 7 | 5 | 0.391 | 3.01 | 5 | 4.5 | None | None | None | None | 4.5 | 3.2 |
| Ex. 8 | 6 | 0.401 | 2.89 | 5 | 4.5 | None | None | None | None | 4.5 | 3.3 |
| Ex. 9 | 7 | 0.390 | 3.10 | 5 | 4.5 | None | None | None | None | 5 | 6.3 |
| Ex. 10 | 8 | 0.389 | 3.11 | 5 | 4.5 | None | None | None | None | 5 | 6.1 |
| Ex. 11 | 9 | 0.451 | 8.21 | 5 | 4.5 | None | None | None | None | 5 | 6.5 |
| Comp. Ex. 1 | 10 | 0.302 | 6.86 | 5 | 4.5 | None | None | Slightly observed | Slightly observed | 5 | 7.5 |
| Comp. Ex. 2 | 11 | 0.353 | 3.77 | 4 | 3 | None | None | Observed | Observed | 5 | 9.2 |
| Comp. Ex. 3 | 12 | 0.33 | 3.89 | 3 | 1.5 | None | None | Observed | Observed | 4 | 17.0 |
| Comp. Ex. 4 | 13 | 0.272 | 30.13 | 4 | 3 | None | None | Observed | Observed | 4.5 | 10.1 |
| Comp. Ex. 5 | 14 | 0.394 | 3.07 | 5 | 4.5 | None | None | Observed | None | 4 | 8.5 |
| Comp. | 15 | 0.392 | 3.08 | 5 | 4.5 | None | None | None | None | 3.5 | 6.8 |

TABLE 2-continued

| | | Fluidity of Toner | | Image Fixing Performance | | Initial Stage (After producing 100 sheets) | | After Producing 800,000 Sheets | | | |
|---|---|---|---|---|---|---|---|---|---|---|---|
| | Toner No. | Loose bulk density (g/cm³) | Cohesiveness (%) | Image fixing Temp. (1)* | Image fixing Temp. (2)** | Defective cleaning | Filming phenomenon | Defective cleaning | Filming phenomenon | Image resolution | Decrease in thickness of photoconductor (μm) |
| Ex. 6 | | | | | | | | | | | |
| Comp. Ex. 7 | 16 | 0.38 | 2.95 | 5 | 4.5 | None | None | None | None | 5 | 7.1 |
| Comp. Ex. 8 | 17 | 0.27 | 28.02 | 5 | 1.5 | None | None | Observed | Slightly observed | 4.5 | 4.5 |
| Comp. Ex. 9 | 18 | 0.335 | 3.76 | 4 | 3 | None | None | Observed | Observed | 4.5 | 5.0 |

*Image fixing temperature (1) is a core temperature of the designated image fixing temperature range.
**Image fixing temperature (2) is lower than the image fixing temperature (1) by 30° C.

As previously explained, the toner or two-component developer according to the present invention exhibits excellent fluidity even though the amount of additive for improving the fluidity of toner particles is small, and does not cause the contamination of the employed photoconductor and the filming phenomenon. Thus, it becomes possible to produce hard copy images with high image fixing performance, high image density, high resolution, and high preciseness.

Japanese Patent Application No. 10-319860 filed Oct. 26, 1998 and 11-067489 filed Mar. 12, 1999 are hereby incorporated by reference.

What is claimed is:

1. A toner comprising toner particles which comprise a binder resin and a coloring agent, wherein said toner particles have a weight-average particle size in a range of 6.0 to 11.5 μm, and comprise:

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

2. A toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content ratio of 3 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

3. The toner as claimed in claim 1, wherein said binder resin comprises a polyol resin.

4. The toner as claimed in claim 2, wherein said binder resin comprises a polyol resin.

5. The toner as claimed in claim 1, wherein said binder resin comprises a polyester resin.

6. The toner as claimed in claim 2, wherein said binder resin comprises a polyester resin.

7. The toner as claimed in claim 1, wherein said toner further comprises a magnetic material.

8. The toner as claimed in claim 2, wherein said toner further comprises a magnetic material.

9. A two-component developer comprising a toner and a carrier, said toner comprising toner particles which comprise a binder resin and a coloring agent, wherein said toner particles have a weight-average particle size in a range of 6.0 to 11.5 μm, and comprise:

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

10. The two-component developer as claimed in claim 9, wherein said carrier comprises magnetic carrier particles with a weight-average particle size of 35 to 100 μm.

11. The two-component developer as claimed in claim 10, wherein said magnetic carrier particles have a weight-average particle size of 45 to 75 μm.

12. A two-component developer comprising a toner and a carrier, said toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content-ratio of 3 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

13. The two-component developer as claimed in claim 12, wherein said carrier comprises magnetic carrier particles with a weight-average particle size of 35 to 100 μm.

14. The two-component developer as claimed in claim 13, wherein said magnetic carrier particles have a weight-average particle size of 45 to 75 μm.

15. A toner cartridge holding therein a toner comprising toner particles which comprise a binder resin and a coloring agent, wherein said toner particles have a weight-average particle size in a range of 6.0 to 11.5 μm, and comprise;

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that;

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

16. A toner cartridge holding therein a toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content ratio of 3 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

17. An image formation method comprising the steps of forming a latent image on a latent image bearing member, developing said latent image to a visible image with a toner, transferring said visible image to an image receiving material, and cleaning said toner remaining on said latent image bearing member, said toner comprising toner particles which comprise a binder resin and a coloring agent, wherein said toner particles have a weight-average particle size in a range of 6.0 to 11.5 μm, and comprise:

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

18. The image formation method as claimed in claim 17, wherein said latent image bearing member is an organic photoconductor belt, and said latent image bearing member is cleaned with a rotational cleaning brush in the form of a roll.

19. An image formation method comprising the steps of forming a latent image on a latent image bearing member, developing said latent image to a visible image with a toner, transferring said visible image to an image receiving material, and cleaning said toner remaining on said latent image bearing member, said toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content ratio of 3 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

20. The image formation method as claimed in claim 19, wherein said latent image bearing member is an organic photoconductor belt, and said latent image bearing member is cleaned with a rotational cleaning brush in the form of a roll.

21. An image formation method comprising the steps of forming a latent image on a latent image bearing member, developing said latent image to a visible image with a two-component developer, transferring said visible image to an image receiving material, and cleaning said toner remaining on said latent image bearing member, said two-component developer comprising a toner and a carrier, said toner comprising toner particles which comprise a binder resin and a coloring agent, wherein said toner particles have a weight-average particle size in a range of 6.0 to 11.5 μm, and comprise:

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

22. The image formation method as claimed in claim 21, wherein said carrier comprises magnetic carrier particles with a weight-average particle size of 35 to 100 μm.

23. The image formation method as claimed in claim 22, wherein said magnetic carrier particles have a weight-average particle size of 45 to 75 μm.

24. The image formation method as claimed in claim 21, wherein said latent image bearing member is an organic photoconductor belt, and said latent image bearing member is cleaned with a rotational cleaning brush in the form of a roll.

25. An image formation method comprising the steps of forming a latent image on a latent image bearing member, developing said latent image to a visible image with a two-component developer, transferring said visible image to an image receiving material, and cleaning said toner remaining on said latent image bearing member, said two-component developer comprising a toner and a carrier, said toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content ratio of 3 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

26. The image formation method as claimed in claim 25, wherein said carrier comprises magnetic carrier particles with a weight-average particle size of 35 to 100 μm.

27. The image formation method as claimed in claim 26, wherein said magnetic carrier particles have a weight-average particle size of 45 to 75 μm.

28. The image formation method as claimed in claim 25, wherein said latent image bearing member is an organic photoconductor belt, and said latent image bearing member is cleaned with a rotational cleaning brush in the form of a roll.

29. An image formation apparatus capable of forming a toner image, using a toner comprising toner particles which comprise a binder resin and a coloring agent, wherein said toner particles have a weight-average particle size in a range of 6.0 to 11.5 μm, and comprise:

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

30. The image formation apparatus as claimed in claim 29, wherein said toner further comprises a magnetic material.

31. An image formation apparatus capable of forming a toner image, using a toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content ratio of 3 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

32. The image formation apparatus as claimed in claim 31, wherein said toner further comprises a magnetic material.

33. An image formation apparatus capable of forming a toner image, using a two-component developer comprising a toner and a carrier, said toner comprising toner particles which comprise a binder resin and a coloring agent, wherein said toner particles have a weight-average particle size in a range of 6.0 to 11.5 μm, and comprise:

toner particles (a) with a particle diameter of 5 μm or less in a content ratio of 1 to 15% by number, and toner particles (b) with a particle diameter of twice or more said weight-average particle size in a content ratio of 5 wt % or less, and satisfy the conditions that:

a number-average particle size D25 when the cumulative number of said toner particles reaches 25% at the measurement of a cumulative toner particle distribution by number thereof, and a number-average particle size D75 when the cumulative number of said toner particles reaches 75% at the measurement of said cumulative toner particle distribution by number thereof are in the relationship of:

$$0.60 \leqq D25/D75 \leqq 0.85.$$

34. The image formation apparatus as claimed in claim 33, wherein said toner further comprises a magnetic material.

35. An image formation apparatus capable of forming a toner image, using a two-component developer comprising a toner and a carrier, said toner comprising toner particles which comprise a binder resin and a coloring agent, wherein said toner particles have a weight-average particle size in a range of 6.0 to 9.5 μm, and comprise:

toner particles (a) with a particle diameter of 5 μm or less in a content ratio of 1 to 12% by number, and toner particles (b) with a particle diameter of twice or more said weight-average particle size in a content ratio of 3 wt % or less, and satisfy the conditions that:

a number-average particle size D25 when the cumulative number of said toner particles reaches 25% at the measurement of a cumulative toner particle-distribution by number thereof, and a number-average particle size D75 when the cumulative number of said toner particles reaches 75% at the measurement of said cumulative toner particle distribution by number thereof are in the relationship of:

$$0.70 \leqq D25/D75 \leqq 0.85.$$

36. The image formation apparatus as claimed in claim 35, wherein said toner further comprises a magnetic material.

* * * * *

UNITED STATES PATENT AND TRADEMARK OFFICE

CERTIFICATE OF CORRECTION

PATENT NO. : 6,183,926 B1
DATED : February 6, 2001
INVENTOR(S) : Noboru Kuroda et al.

It is certified that error appears in the above-identified patent and that said Letters Patent is hereby corrected as shown below:

Title page,
Item[57], second to the last line of the ABSTRACT, "of $0.60 \leq D\ 25/D75 \leq 0.95$." should read -- of $0.60 \leq D25/D75 \leq 0.85$. --.

Column 3,
Line 10, "of 5 $\mu$m" should read -- of 5 $\mu$m or --.

Column 6,
Line 21, "diameter of tone-" should read -- diameter of toner --;
Line 27, "fire toner" should read -- finer toner --.

Column 8,
Line 1, begin new paragraph after "particles." and before "It is";
Line 36, "output Using the" should read -- output using the --.

Column 12,
Line 48, "weights," should read -- weight --.

Column 21,
TABLE 1, Ex. 9 "9.69" should read -- 9.89 --; Ex. 11, "65" should read -- 85 --.

Column 23,
TABLE 2, Comp. Ex. 8 "1.5" should read -- 4.5 --.

Column 30,
Line 11, "toner particle-" should read -- toner particle --.

Signed and Sealed this

First Day of January, 2002

*Attest:*

*Attesting Officer*

JAMES E. ROGAN
*Director of the United States Patent and Trademark Office*